US005943714A

United States Patent [19]

Dignam

[11] Patent Number: 5,943,714

[45] Date of Patent: Aug. 31, 1999

[54] SUSPENDED SLEEPING PLATFORM ASSEMBLY

[76] Inventor: David Dignam, 157 Suffolk St., New York, N.Y. 10002

[21] Appl. No.: 09/212,788

[22] Filed: Dec. 16, 1998

[51] Int. Cl.[6] ..... A47C 17/84

[52] U.S. Cl. ..... 5/10.1; 5/11

[58] Field of Search ..... 5/10.1, 10.2, 11, 5/118

[56] References Cited

U.S. PATENT DOCUMENTS

| | | | |
|---|---|---|---|
| 931,962 | 8/1909 | Rountree | 5/10.2 |
| 1,065,287 | 6/1913 | Welch | 5/10.2 |
| 2,730,213 | 1/1956 | Mason et al. | 5/10.1 X |
| 2,968,048 | 1/1961 | Roberge | 5/10.1 |
| 3,882,554 | 5/1975 | Glass | 5/10.1 |

*Primary Examiner*—Michael F. Trettel
*Attorney, Agent, or Firm*—Mitchell A. Stein; Stein & Associates, P.C.

[57] ABSTRACT

A vertically-displaceable bed platform suspended from a ceiling having a platform with two forward and two rearward engagement regions, and four pulley members each disposed an equal vertical distance from the engagement regions such that two correspond with the forward regions and two with the rearward regions. Four cables are each connected to one of the engagement regions, with a first pair of cables connected to the forward region about the corresponding forward pulleys and joining the corresponding rearward pulleys, and a second pair of cables connected to the rearward regions about the rearward pulleys to join with the first pair of cables. The joined pairs of cables are attached to a counterweight, such that downward motion of the counterweight causes an equal reduction in the four vertical distances and retraction of the platform in the direction of the ceiling to a fully retracted position. Upward motion of the counterweight lowers the platform to a fully vertically extended position by extending the cables an equal distance. A pair of transverse mounted telescoping brace members traverse the distance from the a respective forward region of engagement to the corresponding rearward pulleys, and a pair of crossed telescoping brace members are attached to the rearward portions of the platform to the corresponding rearward pulley members.

6 Claims, 7 Drawing Sheets

SUSPENDED SLEEPING PLATFORM ASSEMBLY

FIELD OF THE INVENTION

The present invention relates to sleeping platforms, and more particularly to an ergonomically augmented sleeping platform assembly vertically displaceably suspended from a pre-existing ceiling structure between stored and open positions.

BACKGROUND OF THE INVENTION

Space has become a recognized commodity, especially in large, congested cities. As a result, it is often the case that people in such environments have spatially limited living accommodations. For example, in single bedroom or studio apartment designs, sleeping space detracts from other space usage including, e.g., entertainment. One solution to this problem has been couch/bed mechanisms including, e.g., futon mattresses, Murphy beds and the like. However, when a couch is also a bed, as in the instance of a futon, guests are frequently sitting on the very mattress that the apartment resident must thereafter employ for sleeping.

Recognition of the problem has resulted in a number of retractable bed designs. For example, U.S. Pat. No. 3,829,912 to Quakenbush shows a retractable bed assembly for recreational vehicles having two inflexible crossed members per side in which one of the respective crossed members is moveably situated in a spring-loaded manner along rails to provide an open and closed state. This complicated device requires a rail-based superstructure on both the bed and roof-mounting superstructure.

U.S. Pat. No. 3,882,554 to Glass shows a retractable bed design having a complex, free-standing superstructure from which a bed platform is suspended with a multiplicity of noncrossed lines.

U.S. Pat. No. 5,377,787 to Chabrier shows an even more complex system in which three out of the four corners of a moving platform assembly travel in vertical rails, and the fourth is suspended by way of a line.

U.S. Pat. No. 5,461,735 to Danton shows a cantilevered wall and ceiling mounted assembly for foldable displacement of a platform.

In the design of a suspended bed assembly, care must be given to minimizing torsional twisting in the open position (in other words, the bed assembly cannot "swing in the breeze"), as well as disappearance in the retracted or closed position to enable close mounting to a ceiling, without the visible intrusion of lines, beams, cross-members and the like. Minimalism in design and operation is a sought-after goal to provide ease of installation, use and aesthetic disappearance of structure.

Accordingly, it is an object of the invention to provide a suspended bed platform that minimizes design elements and torsional twisting effects, while providing ease of use and relative invisibility in the closed position.

SUMMARY OF THE INVENTION

The foregoing and other objects are achieved by the instant invention which comprises a vertically-displaceable bed platform assembly suspended from a ceiling, having a platform member having two forwardly situated and two backwardly situated regions of engagement; four pulley members, each disposed an equal vertical distance from each of the four regions of engagement such that two correspond with the forwardly situated regions and two with the backwardly situated regions; four cables each connected to one of the regions of engagement, in which a first pair of the cables connects from said forwardly situated region about the corresponding forwardly situated pulley members and joining the corresponding backwardly situated pulley members, the second pair of the cables connects from the backwardly situated region about the corresponding backwardly situated pulley members and joins with the first pair of cables at the corresponding backwardly situated pulley members; the joined pairs of cables appended to a counterweight, such that downward motion on the counterweight causes equal reduction in each of the four vertical distances and uniform retraction of the platform member in the direction of the ceiling to a fully retracted position, and upwards motion on the counterweight lowers the platform member an equal distance between each of the regions of engagement and its corresponding pulley member from the fully retracted position to a fully vertically extended position; a pair of transverse mounted, telescoping, rigidifying brace members each substantially traversing the distance from a respective forward region of engagement to a respective corresponding backward pulley member region; and a pair of crossed, telescoping, rigidifying brace members placed on the backward portion; such that displacement of the platform causes equidistant telescoping and detelescoping of each of the brace members.

In this manner, in the instant invention, there are a minimum number of moving parts and bracing members required to provide a bed platform that can be retracted to the ceiling while also be extended to a fully extended position, and all positions there between. In the fully retracted position, the bed platform is substantially against the ceiling, thereby leaving the space available for living or other use. In the fully distended/extended position, the bracing members are locked in place to rigidify the structure, and keep the structure from having any substantially noticeable swing. The bracing members cross in the back region of the invention in order to provide maximum protection against such swing.

The cables are preferably twisted multistranded braided steel. This material will provide a minimum amount of stretch while supporting at least one person who might be sitting or standing on the bed.

The brace members are preferably of a locking- member design for locking when the platform is in its fully vertically extended position, or in its vertically retracted position, or in any position in the in-between. The counterweight preferably has two substantially equally weighted counterweight components which are housed in a sheath that maintains uniform vertical displacement and aesthetically hides the counterweight components.

The bed assembly itself may be sized in conformity with standard mattress and box spring designs (e.g., king, queen, full) or any non-standard design, as may be selected. The bed assembly is configured to provide for a mattress with or without a box spring provided thereupon.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements through the several views.

DETAILED DESCRIPTION OF THE PREFERRED EMBODIMENTS

Figure 1:
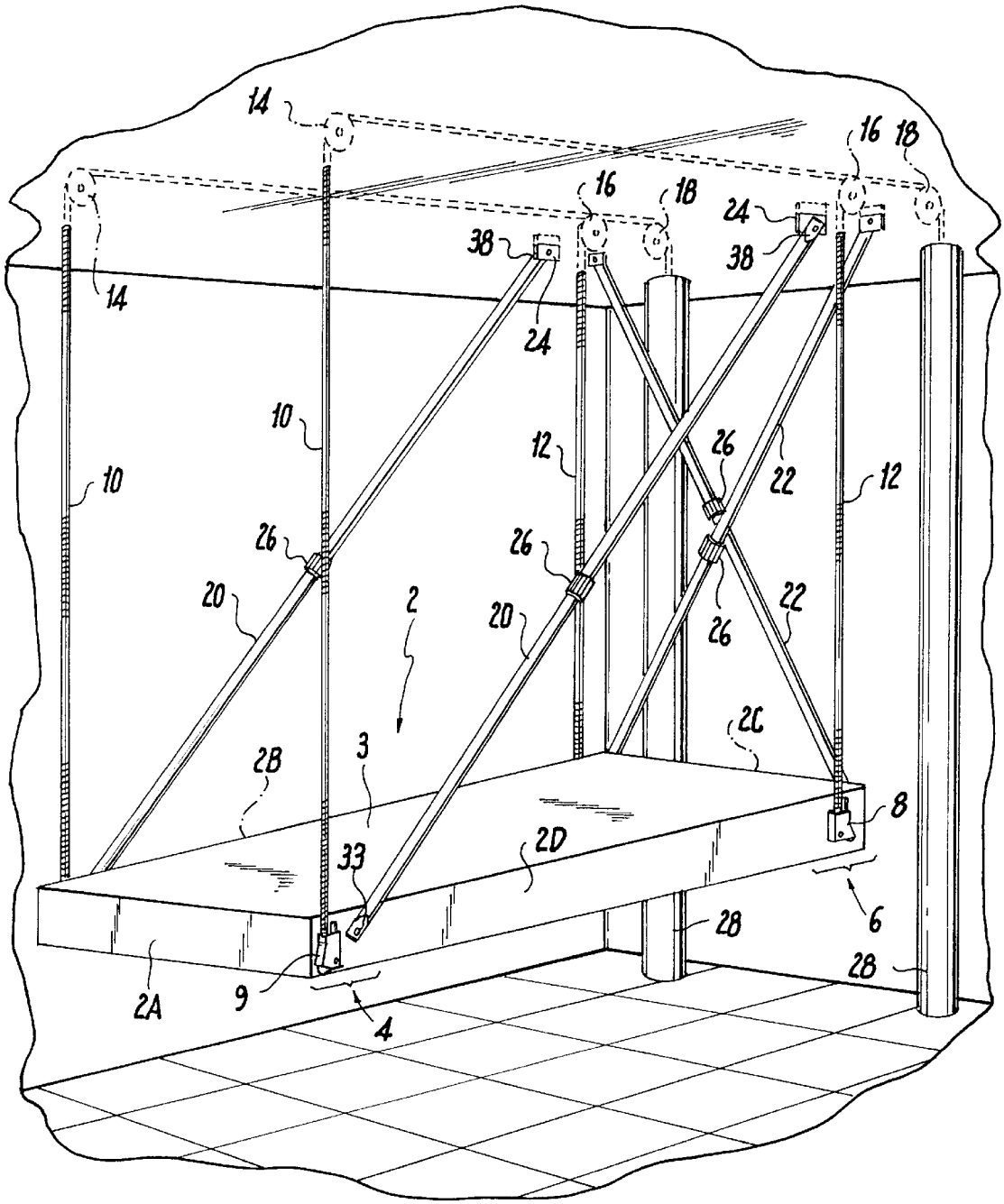
FIG. 1 is a frontal perspective view of the bed platform assembly in an extended position, in accordance with a preferred embodiment of the invention.
Figure 11:
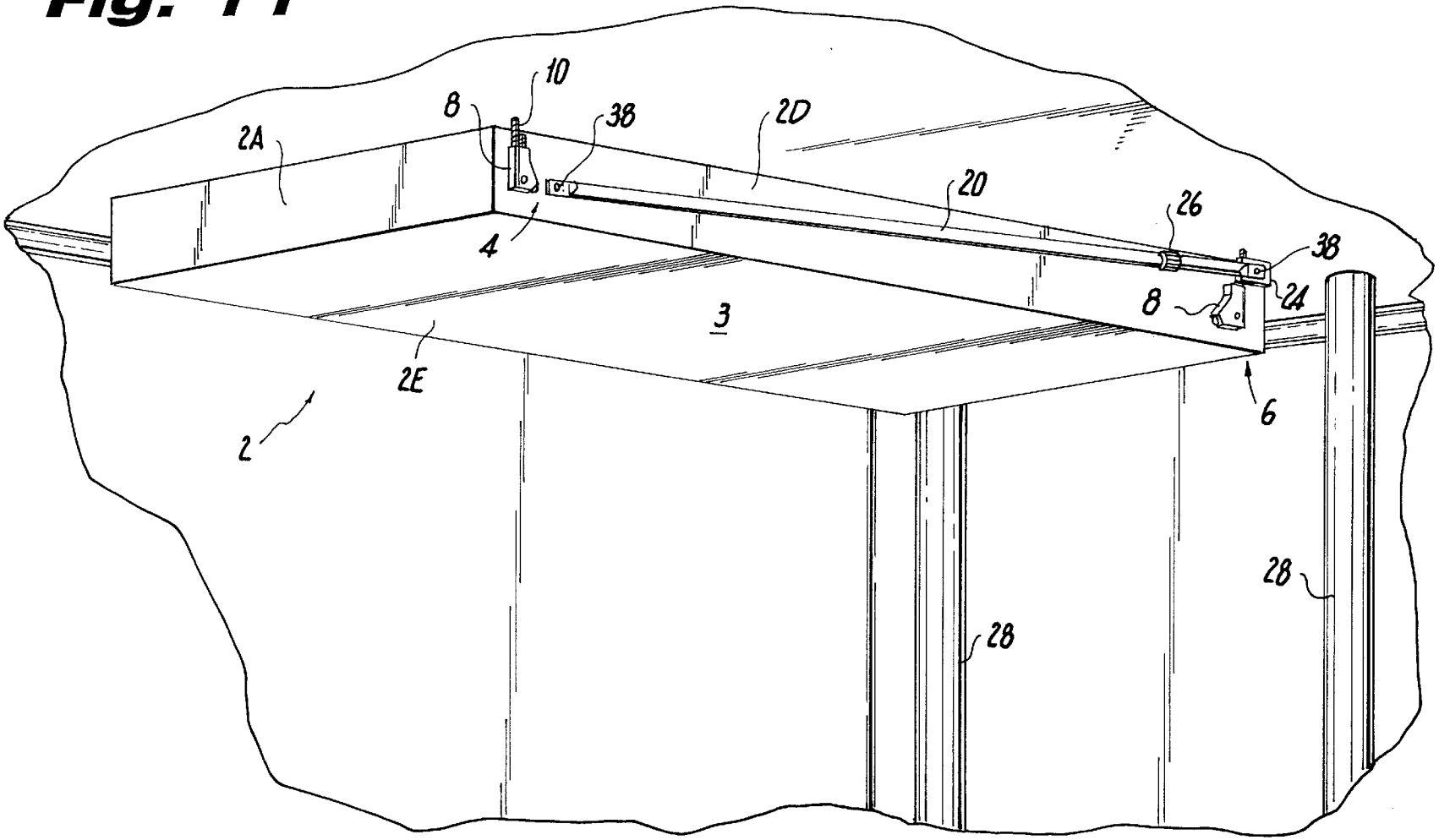
FIG. 11 is a side-view perspective of the bed platform assembly in its fully retracted position.

As shown in FIG. 1, the present invention is directed to a platform bed assembly 2 with platform member 3 having forward edge 2A, side edges 2B and 2C, rear edge 2D and base 2E (as shown in FIG. 11). Platform member 3 can either be a flat platform comprised of a single piece of wood or other material, or create a generally concave region in which a mattress with or without a box spring can be situated, depending upon the design choice.

Platform member 3 has a forwardly situated region of engagement 4 and a rearwardly/backwardly situated region of engagement 6. In these regions of engagement, cable retaining means 8 are provided. Cable retaining means 8 generally provide for retention of the tailing end of each of the first or forward pair of cables 10 and second or rearward pairs of cables 12. Cables 10 and 12 are generally comprised of resilient, non-stretchable, load-bearing material including, e.g., braided steel employed for vessel spars and stays. The diameter and material of cables 10 and 12 must be such to permit full-load bearing of at least 600 lbs. in the preferred embodiment to enable the full weight of the mattress with or without the box spring, as well as at least two people who may simultaneously be supported.

Each of cables 10 are trained about pulleys 14 which, as shown in subsequent figures, are attached to ceiling beams. Each of cables 12 are, in turn, trained about pulleys 16, also attached to ceiling beams. Cables 10 meet cables 12 at the rearward portion of the bed assembly 2, and are trained about another set of pulleys 18. Thereafter, the combination of ganged or joined cables 10, 12 attach to counterweight members 34, shown in subsequent drawings. Counterweight members 34 are housed in an aesthetically determined, yet functional sheath 28.

Also shown in FIG. 1 are side brace members 20 which extend from the forwardly situated region of engagement 4 to a beam and attach by way of a pivoting engagement means 38 (like a bolt assembly or bearing) to a beam attachment plate 24. Also, the point of engagement of brace members 20 to side edges 2B, 2C are likewise pivoting engagement means 38.

Two additional brace members 22 are provided in the rear of the platform assembly 2 in order to provide cross-bracing for greater elimination of swing, while providing additional structural and load-bearing support. Such brace members 22 are attached by the same form of beam attachment plates 24 and pivoting engagement means 38 as brace members 20.

Brace members 20, 22 are telescoping by way of concentric tubular form, which are locked into place by locking members 26 (like a painter's pole). The preferred material for brace members 20, 22 is aluminum or a metal matrix. In other words, once the bed platform assembly 2 is situated in the desired location, locking members 26 are twisted and brace members 20, 22 hold the assembly in that location.

Figure 2:
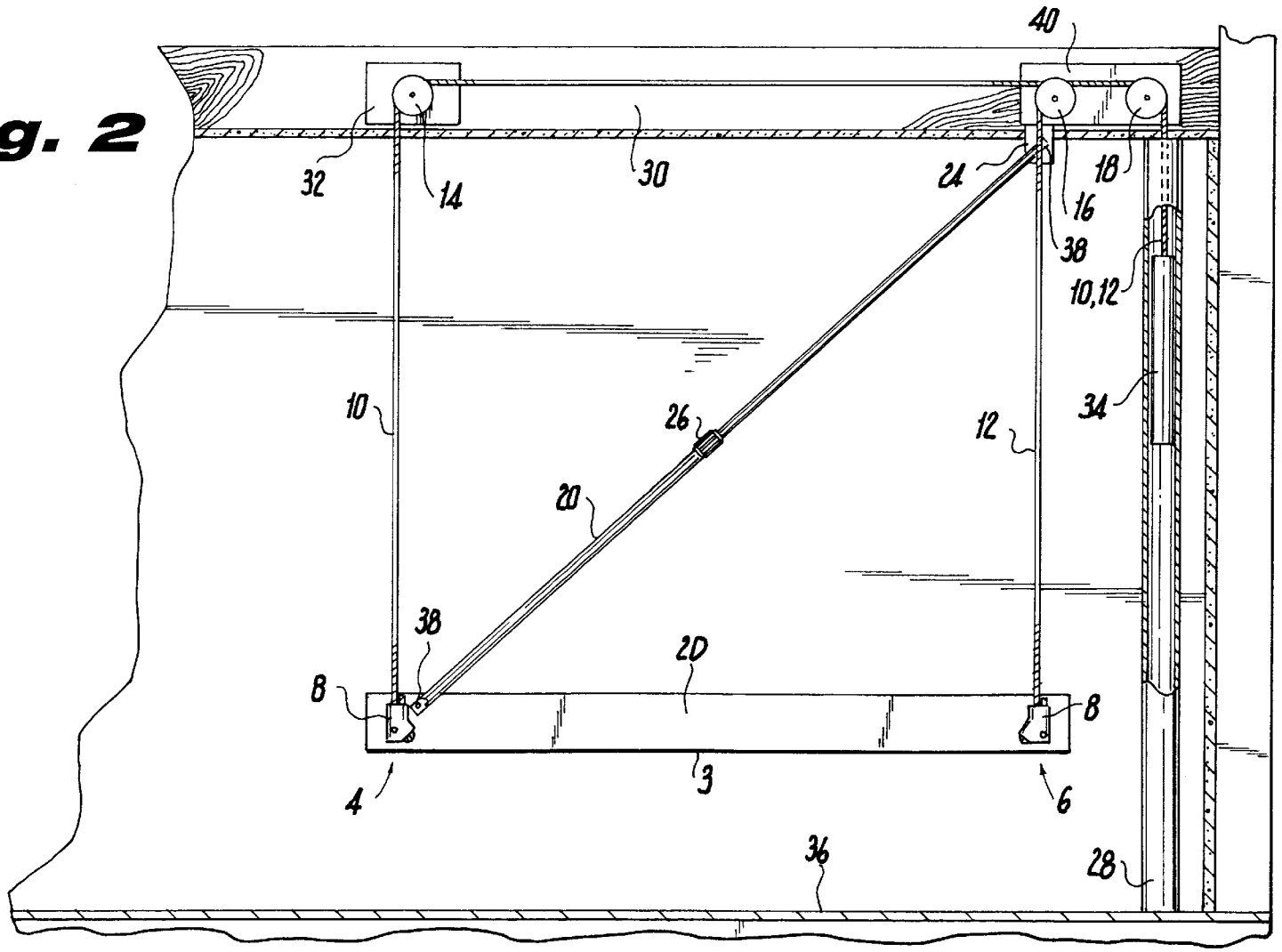
FIG. 2 is a side view of the bed platform assembly in an extended position.

In FIG. 2, a side view of the assembly 2 is shown with platform member 3, and side edge 2D. Forward region of engagement 4 and Rearward region of engagement 6 are shown with cable retaining means 8, cables 10 and 12, and side brace member 20 with its locking member 26. Pulleys 14 is shown attached to beam 30 by way of attachment plate 32. Likewise, pulleys 16 and 18 are shown attached to beam 30 by way of attachment plate 40. As shown in FIG. 2, cables 10 and 12 join between pulleys 16 and 18 and then attach to one of the counterweight members 34, housed in counterweight sheath 28. Also visible are pivoting engagement means 38 and beam attachment 24. Floor 36 is also visible.

Figure 3:
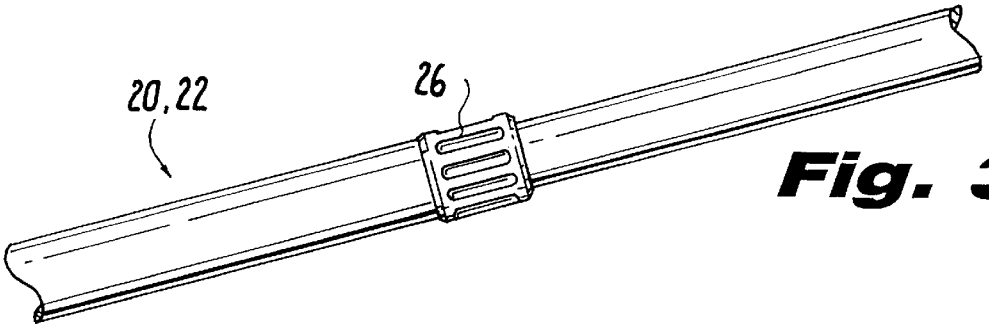
FIG. 3 is a close-up view of the locking portions of the brace members.
Figure 4:
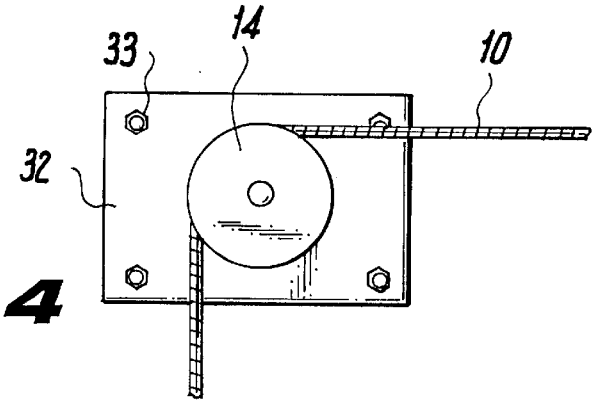
FIG. 4 is a close-up view of a pulley having a cable wound thereabout.
Figure 5:
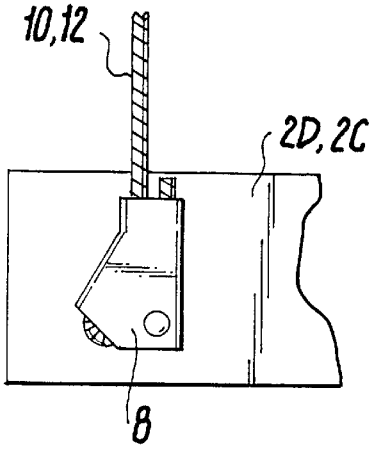
FIG. 5 is a close-up view of a regional engagement member for engaging one of the cables on the platform assembly.

FIG. 3 shows a close-up of a brace member 20, 22 with its locking member 26. FIG. 4 shows the attachment plate 32 with four bolts 33, and pulley 14, with cable 10 trained thereabout. FIG. 5 shows the cable retaining means 8, in which cable 10, 12 is compressed against edge 2D, 2C in order to prevent cable 10, 12 from being pulled out during loading of platform assembly 2.

Figure 6:
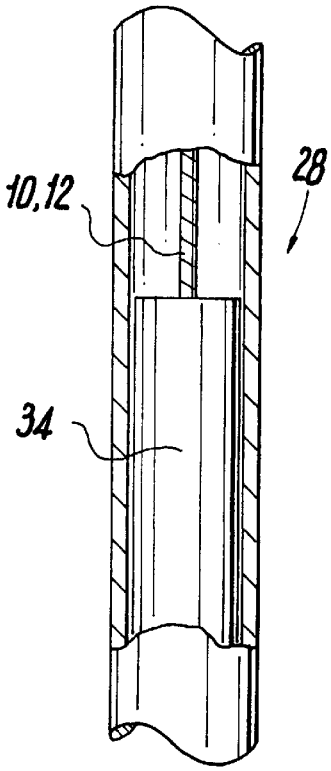
FIG. 6 is a close-up view of a counterweight member housed in its aesthetically protective sheath.

FIG. 6 shows a cut away view of counterweight member 34, suspended by way of cable 10, 12 in sheath 28. In another embodiment, each of counterweight members 28 are attached to a horizontal beam, sheath 28 is cut in a "c" formation to accommodate the horizontal beam, thereby enabling the counterweight members 28 to move vertically in substantially the same amounts to enable the platform member 3 to be evenly moved, and to remain substantially planarly parallel to the floor and ceiling.

Figure 7:
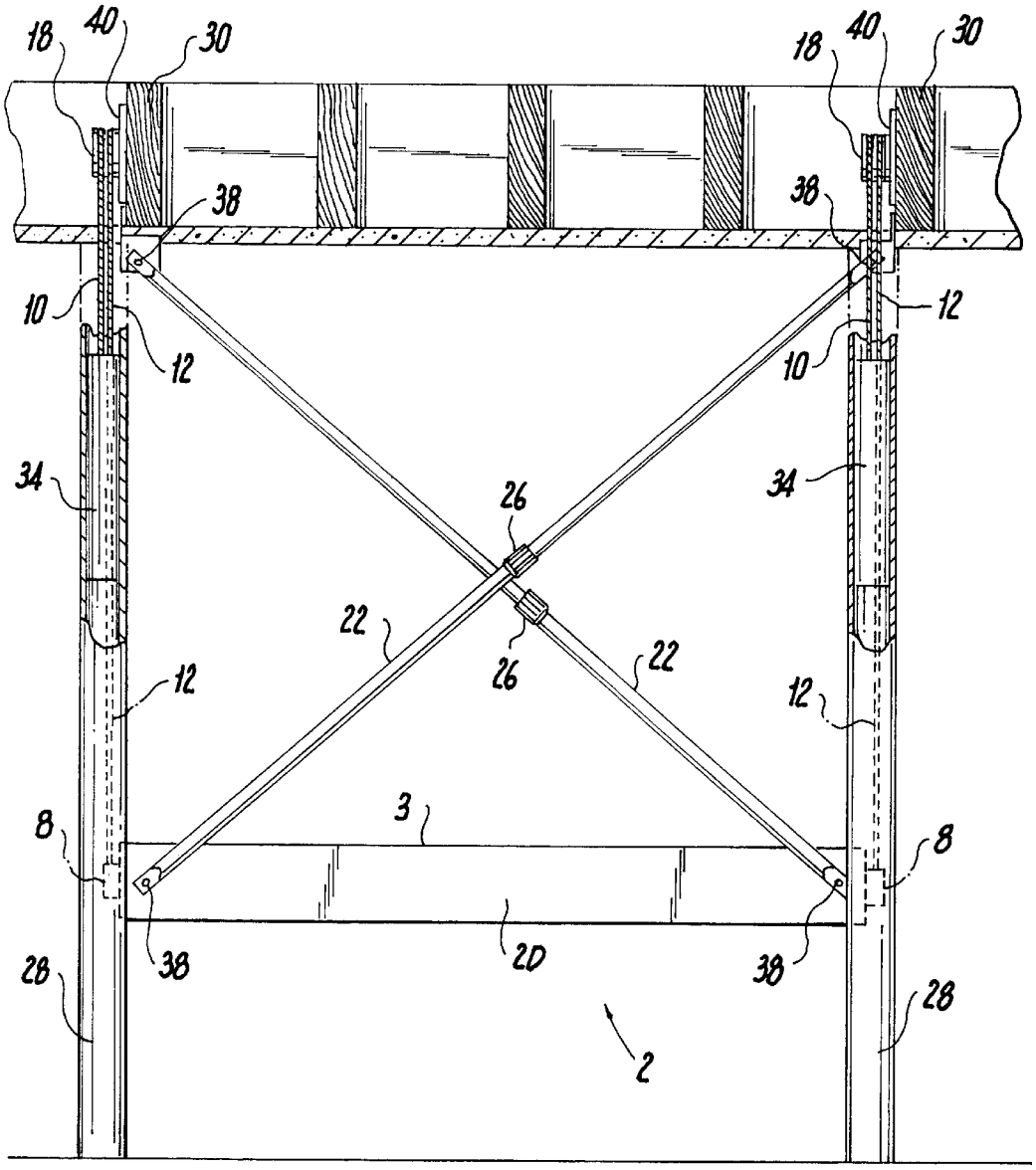
FIG. 7 is a rear-view of the bed platform assembly in an extended position.

FIG. 7 shows a rear view of platform assembly 2 showing platform member 3, and its rear edge 2C. All elements shown in FIG. 7 have the same functions and connections as hereinbefore described. Because of this view, it may appear that cable 12 is attached to the bottom of counterweight members 34. This is not so, but only a consequence of the perspective.

Figure 8:
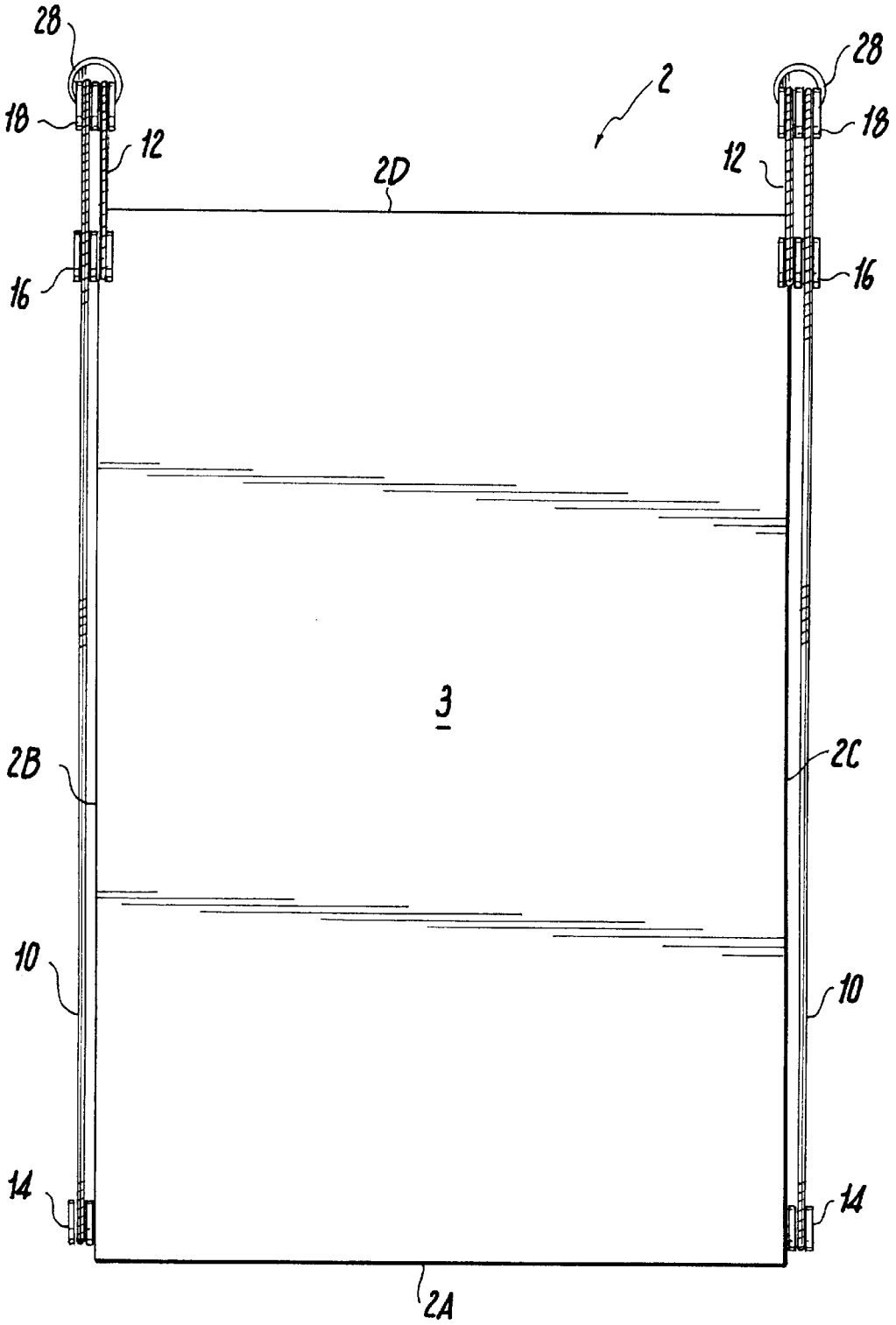
FIG. 8 is a downwardly directed view of the bed platform assembly.

Likewise, FIG. 8 shows a downwardly directed view of platform assembly 2, in which all elements have hereinabove been described.

Figure 9:
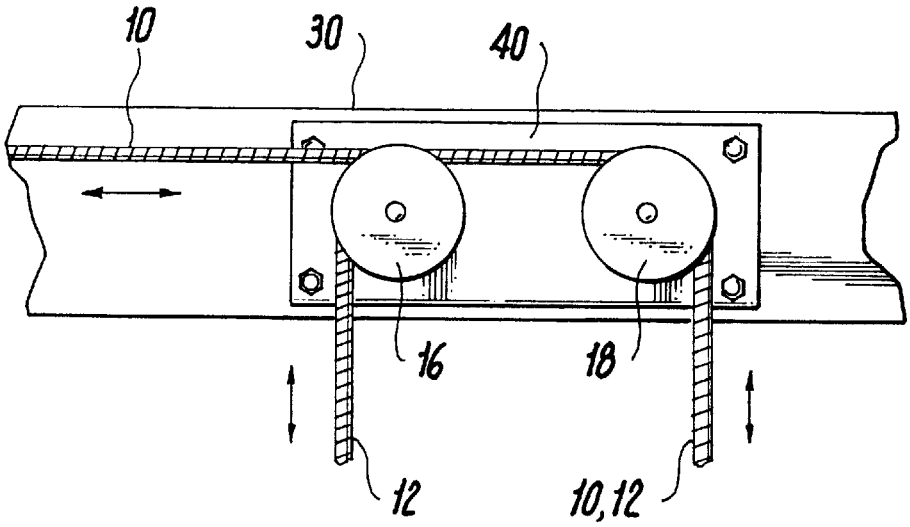
FIG. 9 is a close-up view of the double-pulley engagement at the rear area of the bed platform assembly.
Figure 10:
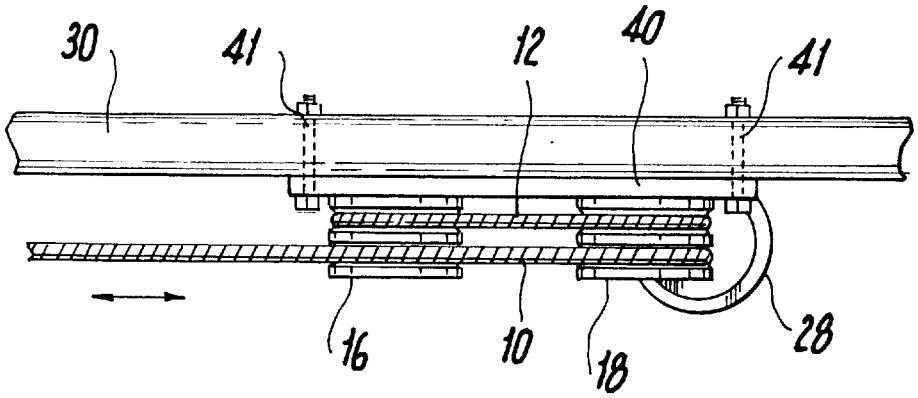
FIG. 10 is a close up side-view of the double-pulley engagement.

FIGS. 9 and 10 are cut away view of the cable and pulley runs of pulleys 16 and 18, attached by way of double pulley attachment plate 40 to beam 30. Each of pulleys 16 and 18 actually comprise double-pulley mechanisms to enable each of cables 10 and 12 to have an independent pulley to train about, while allowing simultaneous ganged or joined action. Also shown in FIG. 10 are bolts 41 for fastening attachment plates 40 to beam 30.

FIG. 11 shows bed assembly 2 in its fully retracted position, flush against a ceiling. In this embodiment, it should be understood that brace members 20, 22 are fully compressed, and the bed assembly 2 is retained in this position by locking members 26.

It should be appreciated that it is within the scope of the art to motorize this assembly, and to also provide locking mechanisms for counterweight members 34 to enable locking in various positions.

While there have been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

I claim:

1. A vertically-displaceable bed platform assembly suspended from a ceiling, comprising:

(a) a platform member having two forwardly situated and two backwardly situated regions of engagement;

(b) four pulley members, each disposed an equal vertical distance from each of said four regions of engagement such that two correspond with said forwardly situated regions and two with said backwardly situated regions;

(c) four cables each connected to one of said regions of engagement, in which a first pair of said cables connects from said forwardly situated region about said corresponding forwardly situated pulley members and joining said corresponding backwardly situated pulley members, the second pair of said cables connects from said backwardly situated region about said corresponding backwardly situated pulley members and joins with said first pair of cables at said corresponding backwardly situated pulley members;

(d) said joined pairs of cables appended to a counterweight, such that downward motion on said counterweight causes equal reduction in each of said four vertical distances and uniform retraction of said platform member in the direction of the ceiling to a fully retracted position, and upwards motion on said counterweight lowers the platform member an equal distance between each of said regions of engagement and its corresponding pulley member from said fully retracted position to a fully vertically extended position;

(e) a pair of transverse mounted, telescoping, rigidifying brace members each substantially traversing the distance from a respective forward region of engagement to a respective corresponding backward pulley member region; and (f) a pair of crossed, telescoping, rigidifying brace members placed on the backward portion;

(g) such that displacement of the platform causes equidistant telescoping and detelescoping of each of said brace members.

2. The vertically displaceable bed platform of claim 1, wherein said cables are comprised of twisted multistranded braided steel.

3. The vertically displaceable bed platform of claim 1, wherein said brace members further comprise a locking member for locking the brace members when said platform is in its fully vertically extended position, in its fully retracted position, and in any position there between.

4. The vertically displaceable bed platform of claim 1, wherein said counterweight is comprised of two substantially equally weighted counterweight components.

5. The vertically displaceable bed platform of claim 4, wherein each of said counterweight components is housed in a sheath formulated to maintain uniform vertical displacement of said components and to aesthetically hide said components.

6. The vertically displaceable bed platform of claim 1, wherein said joined pairs of cables first traverse another pulley member prior to engagement to said counterweight.

* * * * *